US005350215A

United States Patent [19]

DeMars

[11] Patent Number: 5,350,215

[45] Date of Patent: Sep. 27, 1994

[54] LEISURE CHAIR

[76] Inventor: Robert A. DeMars, 23221 Ladrillo Ave., Woodland Hills, Calif. 91367

[21] Appl. No.: 8,316

[22] Filed: Jan. 25, 1993

[51] Int. Cl.[5] ..... A47C 7/62; A47C 1/14

[52] U.S. Cl. ..... 297/194; 297/129; 297/35; 297/184.16

[58] Field of Search ..... 297/194, 188, 39, 129, 297/35, 184.16

[56] References Cited

U.S. PATENT DOCUMENTS

| | | | |
|---|---|---|---|
| 932,389 | 8/1909 | Haydu | 297/35 |
| 1,963,708 | 6/1934 | Marvin | 297/35 |
| 2,061,302 | 11/1936 | Egler | 297/194 |
| 3,295,886 | 1/1967 | Goldmestein | 297/194 |
| 4,339,061 | 7/1982 | Dunn | 297/194 |
| 4,470,630 | 9/1984 | Shields | 297/39 |
| 4,514,009 | 4/1985 | Vanderminden | 297/35 |
| 4,676,548 | 6/1987 | Bradbury | 297/129 |
| 4,863,003 | 9/1989 | Carter | 297/188 |
| 4,892,353 | 1/1990 | Goddard | 297/188 |
| 4,938,603 | 7/1990 | Turner et al. | 297/35 |

*Primary Examiner*—Brian K. Green
*Assistant Examiner*—David E. Allred
*Attorney, Agent, or Firm*—Jack C. Munro

[57] ABSTRACT

A chair that is constructed of a plurality of interconnected tubular frame members with a flexible fabric-like cover covering sections of the tubular frame members forming a back section and a seat section. The chair is foldable from an extended/usable position to a retracted/stowage position. The chair includes armrests and attached to each armrest is a flexible walled container which is insulated to be usable to store beverage containers in a refrigerated condition. These flexible walled containers are joinable together when the chair is in the retracted/stowage position with the joining of these containers facilitating retaining of the chair in this retracted/stowage position. Back pack straps are attached to the back section which permits the chair to be carried on the back of a human being when the chair is in the retracted/stowage position.

6 Claims, 4 Drawing Sheets

LEISURE CHAIR

BACKGROUND OF THE INVENTION

1. Field of the Invention

The field of this invention relates to a folding chairs that are readily transportable to be used at the beach and other leisure uses.

2. Description of the Prior Art

Chairs for beach, picnicking, backpacking and other outdoor use have long been known. One of the most common uses for such a chair is at the beach. Beach chairs have been constructed of a plurality of, light in weight, metallic tubular members with a fabric or plastic webbing being stretched across the members in order to form a seat section and a back section. Generally, these chairs are foldable from a collapsed position, occupying a minimum amount of space and facilitating portability, to an extended position which causes the leg assembly to be extended from the back section assuming a substantially right angled position to the seat section. In the past, these types of chairs have been merely carried to the beach along with other beach paraphernalia.

As an improvement to this conventional beach type of chair there has been designed collapsible type of chairs which could be transported to the beach by being carried on one's back. Also, it has been known in the past to construct a beach chair which includes pouches which could be utilized to store articles such as suntan oil, comb, brush and so forth. It has also been known to construct a beach chair which is to be usable in conjunction with an umbrella to protect the user from excessive exposure to the sun. However, little effort has been expended in the past in designing such chairs so that the chairs are of quality construction and quickly movable to the collapsed or retracted position and at the same time are quickly movable into the extended or usage position, and include necessary additional items usable by normal beach goers such as an ice chest and an umbrella.

SUMMARY OF THE INVENTION

A chair which is constructed of a back section which is located substantially at a right angle to a seat section with there being located under the seat section a leg assembly. Interconnecting the back section and the seat section are a pair of armrests located at each side of the seat section. Mounted on each armrest is a flexible walled pouch with this pouch being openable in order to gain access into the interior of the pouch or being completely closed relative to the ambient. The pouch is constructed to be insulative so as to retain cold or heat so that cold beverage containers can be maintained cold for a period of time when contained within the pouch or even a heated beverage can be maintained at an elevated temperature for a short period of time. Each of the pouches include an attaching flap with this attaching flap being wrapped around its respective armrest and secured. With the chair in the extended usable position, each pouch is located along the outer surface of its respective armrest. When the chair is in this retracted/-stowage position, each of the pouches is to be pivoted about two hundred and seventy degrees with the pouches then being joined together by a joining arrangement such as a zipper. These connected together pouches tend to maintain the chair in the retracted/-stowage position when such are joined together. Associated with each armrest is a protrusion which functions as a locking device to interlock with the back section to further maintain the retracted/stowage position of the chair. There is an umbrella that is located in a stowage position with the chair when the chair is in the retracted/stowage position. This umbrella is to be disengaged from its stowage position and is to be connectable with the bracket mounted at the upper edge of the back section to locate the umbrella in a usable position when the chair is in the extended/usage position.

The primary objectives of the present invention is to construct a chair which is light in weight, can be collapsed to occupy a relatively small amount of space, facilitates transportability to a remote location, can be conveniently carried by a human being leaving the arms and hands of the human being free from carrying of the chair, rugged in construction, can be manufactured inexpensively and thereby sold to the ultimate consumer at an inexpensive price, includes ice chest type of pouches for maintaining liquid containers cold or hot for period of time, and also which includes an umbrella in order to protect the user from extended periods of exposure to the sun.

Another objective of the present invention is to construct a chair that when in the collapsed state occupies a sufficiently small enough space so that it can be placed within a box so as to facilitate shipping by any conventional shipping company including Federal Express, UPS and the Post Office.

DETAILED DESCRIPTION OF THE SHOWN EMBODIMENT

Figure 1:
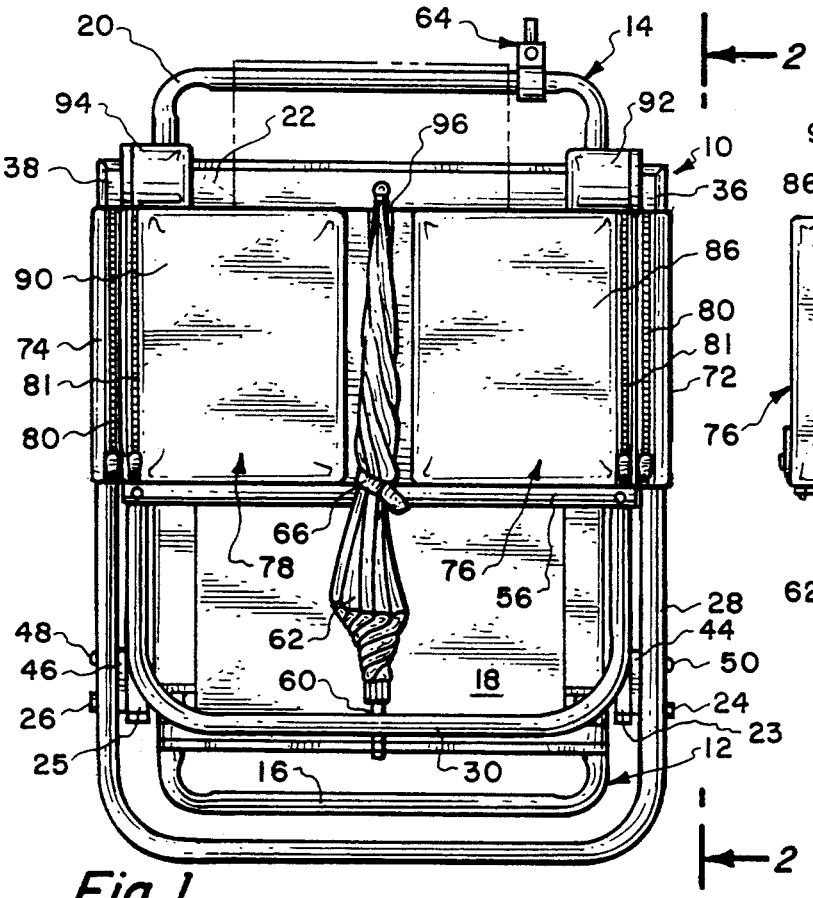
FIG. 1 is a front view of the chair of the present invention showing the chair in the retracted/stowage position.

Referring particularly to the drawings there is shown the chair 10 of this invention which is constructed generally of a seat section 12 and a back section 14. The seat section 12 is constructed of a U-shaped metallic tubular member 16 with a section of fabric 18 being tightly stretched between the legs of the U-shaped tubular member 16. The fabric 18 is wrapped around the legs of the tubular member 16 and secured on itself in a conventional manner.

Figure 3:
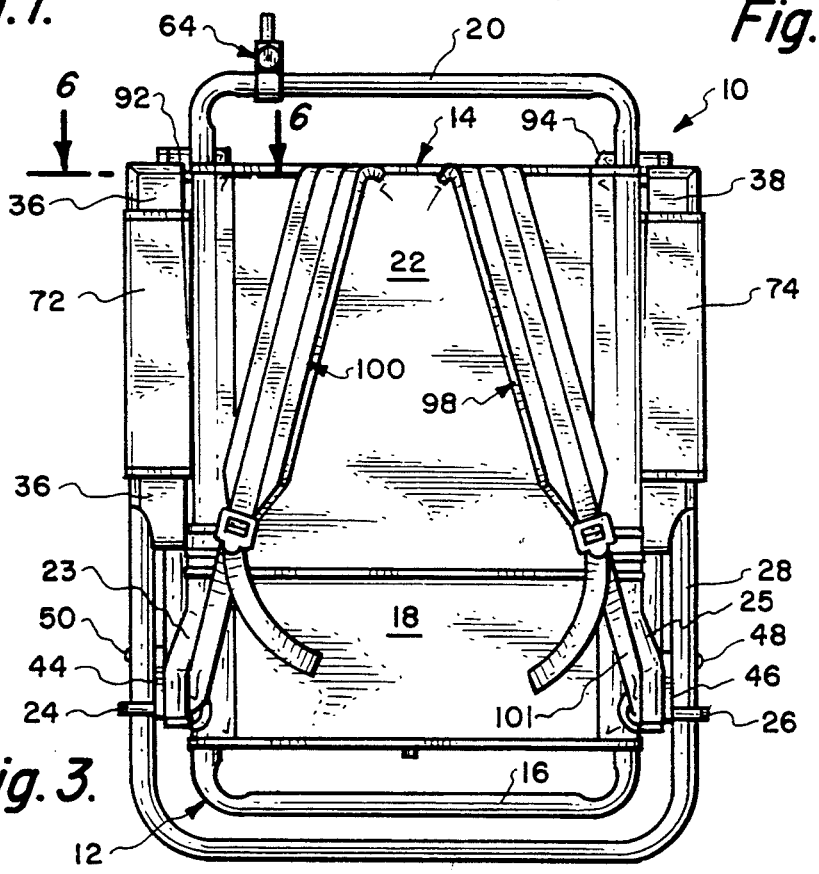
FIG. 3 is a back view of the chair of the present invention taken along line 3—3 of FIG. 2.
Figure 8:
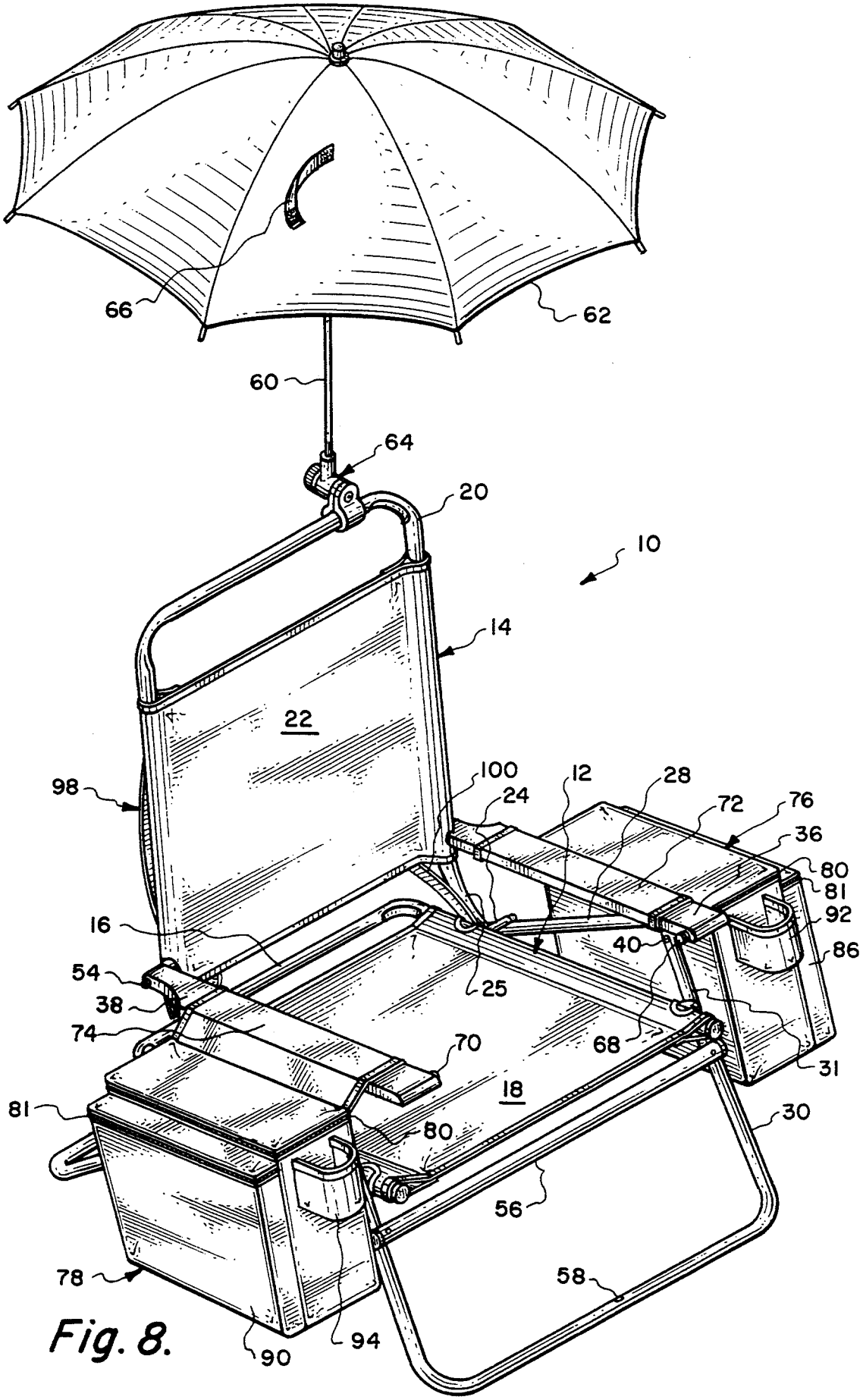
FIG. 8 an isometric view showing the chair of the present invention in its extended/usage position.

The back section 14 is also formed of a metallic tubular member 20 which has a section of fabric 22 tightly stretched between the legs of the tubular member 20 and secured in a manner as previously described in relation to fabric 18. The outer free end 23 of one of the legs of U-shaped member 20 is pivotally mounted on a stub shaft 24. The outer free end 25 of the remaining leg of the U-shaped member 20 is pivotally mounted on a second stub shaft 26. As seen in FIG. 3, the outer free end 23 is bent outwardly a short distance. The same is true for outer free end 25. The stub shaft 24 is fixedly mounted to one leg of U-shaped member 16 with stub shaft 26 being fixedly mounted to the opposite leg of U-shaped member 16. Stub shaft 24 is of sufficient length to abut against back leg member 28 when the chair is in the extended/usable position as shown in FIG. 8.

Back leg member 28 is also constructed as a U-shaped tubular member. One free ends of bifurcated leg member 28 is pivotally mounted by pin 40 to outer free end 31 of a forward leg member 30 which is also bifurcated. The remaining free end of bifurcated leg member 28 is pivotally mounted by pin 42 to outer free end 33 of the forward leg member 30. Outer free ends 31 and 33 are each bent slightly relative to the rest of the leg member 30 in the area of connection to a cross brace 56. This bending gives the appearance that outer free end 31 is not part of leg member 30 in FIG. 8 when in fact it is part of leg member 30. Forward leg member 30 is also in the form of a U-shaped tubular member. Pin 40 rides within slotted plate 32. Pin 42 rides within an almost identical slotted plate 34. The slotted plate 32 is attached to the undersurface of armrest 36. The slotted plate 34 is fixedly secured to the undersurface of armrest 38. Bracket 32 has an elongated slot with pin 40 being movable within that slot. In a similar manner, there is elongated slot within the plate 34 with pin 42 being movable within the confines of that slot. Each of the slots within the brackets 32 and 34 include a plurality of different stations and each pin 40 and 42 is capable of engaging with a respective station. The pins 40 and 42 will always connect with stations that are in lateral alignment. With the pins 40 and 42 connecting with the forwardmost station, the back section 14 is located almost precisely at a right angled position relative to the seat section 12. As the pins 40 and 42 engage with other stations, the back section 14 will assume a more angled position relative to the seat section 12. It is to be noted that the slots and the stations formed in the brackets 32 and 34 are not shown but are deemed to be conventional. The stations and the slots will resemble what is frequently termed a bayonet slot arrangement.

Pivotally connected with stub shaft 24 is one end of a link 44. The opposite end of the link 44 is pivotally mounted to the rear leg member 28 In a similar manner, the stub shaft 26 has pivotally mounted thereto one end of a link 46. The opposite end of the link 46 is similarly pivotally mounted by means of a pin 48 to the rear leg member 28. A pin 50 pivotally mounts the link 44 to the leg member 28. It is the function of the links 44 and 46 to permit the leg member 28 to move between its extended position as shown in FIG. 8 to its retracted position shown in FIG. 2. When in the retracted position shown in FIG. 2, the rear leg member 28 is located in juxtaposition to the front leg member 30.

The inner end of the armrest 36 is pivotally connected by means of a bolt 52 to one leg of the tubular member 20. In a similar manner, the inner end of the armrest 38 is pivotally connected by means of a bolt 54 to the opposite leg of the tubular member 20. When the chair 10 of this invention moves from the extended/usable position shown in FIG. 8 to the retracted/stowage position shown in FIGS. 1 and 2, the armrests 36 and 38 will pivot from an almost perpendicular position relative to the back section 14 to a parallel position to the back section 14.

Figure 2:
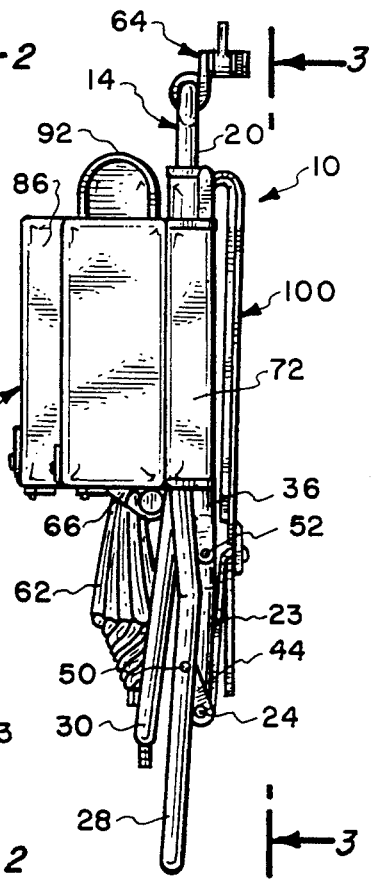
FIG. 2 is a right side view of the chair of this invention taken along line 2—2 of FIG. 1.

The leg members 28 and 30 assume a substantially right angle position relative to each other when the chair is in the extended/usable position as shown in FIG. 8. When the chair is in the retracted/stowage position as shown in FIGS. 1 and 2, the leg member 30 actually rests within the confines of leg member 28. Also located within the confines of leg member 28 is tubular member 16 of the seat section 12. In order to strengthen leg member 30, secured between the legs of the leg member 30 is the a tubular metallic cross brace 56.

Figure 4:
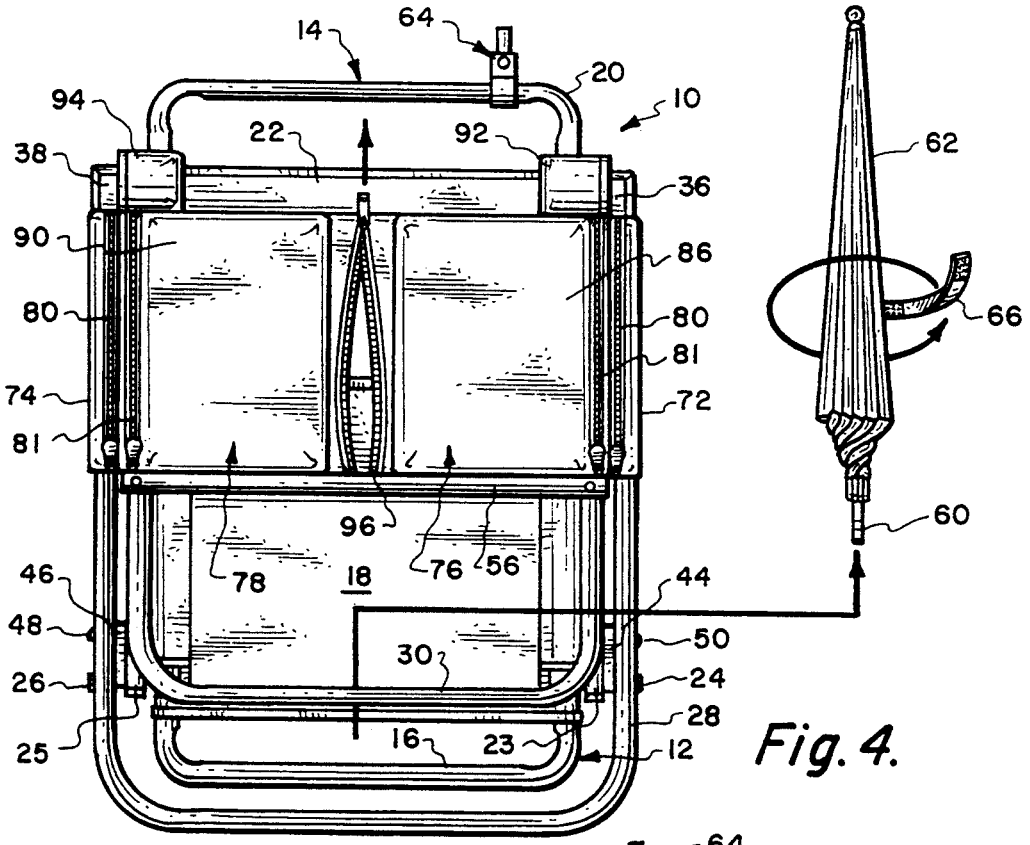
FIG. 4 is a view similar to FIG. 1 but showing the umbrella disengaged from its stowage position and the zipper being unzipped which interconnects the ice chest type of pouches.
Figure 5:
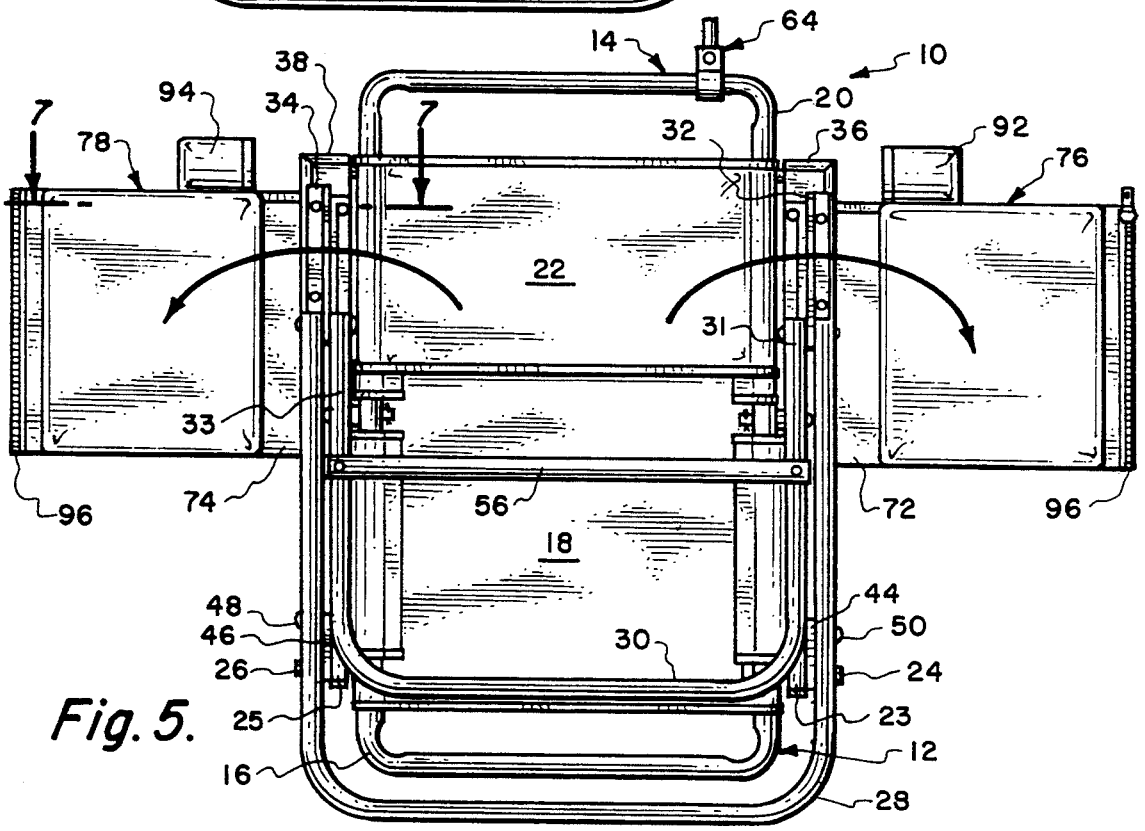
FIG. 5 is a view similar to FIG. 4 but showing the ice chest pouches being moved to an outward position.

The apex section of the leg member 30 includes a hole 58 The hole 58 is substantially centrally located within the apex section of the leg member 30. When the chair is in the retracted/stowage position, the bottom end of a shaft 60 is located within the hole 58. Attached to the upper end of the shaft 60 is a cover 62 of an umbrella. The cover 62 can assume the extended position as shown in FIG. 8 with the shaft 60 then being connected to a swivel bracket assembly 64 that is mounted on the apex section of a leg member 20. The swivel bracket assembly 64 can be adjusted to any desired position along the apex section of the leg member 20. Also, the umbrella can be pivoted to any desired position according to the desires of the user, Normally, the cover 62 of the umbrella will be used to shield the user from the rays of the sun when the chair is located at the beach. The cover 62 can occupy a collapsed position as shown in FIGS. 1 and 4. With the cover 62 is in this collapsed position, the shaft 60 is located within the hole 58. There is a strap 66 mounted on the cover 62 and this strap 66 is to be conducted around the bracing tube 56 and around the body of the cover 62 of the umbrella and then secured with the umbrella then being retained in its stowage position with this position being clearly shown in FIGS. 1 and 2 of the drawings.

There is a locking arrangement to help maintain the chair in the retracted/stowage position. This locking means comprises a protuberance 68 located on the inside of armrest 36 and protuberance 70 mounted on the inside of armrest 36. Both protuberances 68 and 70 are located at the outer free end of the respective armrests 36 and 38. When the chair is moved to the retracted/stowage position, the protuberance 68 comes into contact with leg member 20. Also, protuberance 70 comes into contact with leg member 20. The protuberances 68 and 70 as well as their respective armrests 36 and 38 will deflect slightly around the leg member 20 and then deflect slightly inwardly after passing the leg member 20. As a result, a locking arrangement is obtained tending to maintain the chair 10 in the retracted/stowage position.

When it is desired to move the chair 10 to the extended/usable position, a simple manual movement deflecting of the armrests 36 and 38 and their respective protuberances 68 and 70 around the leg member 20 is required which will then free the armrests 36 and 38 so that such can move to the perpendicular position shown in FIG. 8 relative to the seat section 14.

Attached to the undersurface of the armrest 36 is a fabric type of flap 72. Similarly attached to the armrest 38 is a fabric type of flap 74. Each of the flaps 72 and 74 are basically wrapped around the body of their respective armrest 36 and 38. Flap 72 is integrally connected to a flexible walled (generally of a fabric construction) pouch 76. Flap 74 is integrally connected to a pouch 78. Pouches 76 and 78 are basically identical in construction but mirror images relative to the chair 10.

Each of the pouches 76 and 78 have an enlarged main compartment 82 which is normally closed by means of a zipper 80. A divider wall 84 is mounted within the compartment 82. Generally the function of the compartment 82 will be to keep soda and beer beverage containers cold or other beverage containers hot such as coffee. Therefore, the construction of the walls of the pouches 76 and 78 are intended to include an insulative material. A common form of construction would be to include a foam or other similar type of insulating material in conjunction with the walls of the pouches 76 and 78.

Associated with the pouch 76 is a small pouch 90 which includes a small article containing compartment 88 adapted to contain articles such as a comb, brush, suntan lotion and the like. A similar such small pouch 86 is connected to pouch 76. Small pouch 86 has an article containing compartment (not shown) which is similar to compartment 88. Also connected to pouch 76 is a cup-shaped sleeve 92 within which a beverage container is to be supported which is in current use. Also attached to the pouch 78 is a similar cup-shaped sleeve 94. Access into small pouches 86 and 90 is provided by a zipper 81 for each small pouch 86 and 90.

When the chair 10 is in the retracted/stowage configuration, the pouches 76 and 78 are to be connected together in an aligned position by means of a zipper 96 as is clearly shown in FIGS. 1 and 4. So locating together of the pouches 76 and 78 tends to maintain the retracted/stowage position of the chair 10 and adds to the overall locking arrangement defined by protrusions 68 and 70. When the chair 10 is in the extended/usable position, the pouches 76 and 78 are spaced apart in positions substantially parallel to each other as is clearly shown in FIG. 8.

Fixedly mounted on the back of the back section 14 are a pair of strap assemblies 98 and 100. These strap assemblies 98 and 100 are to be used by a human being to mount the chair 10 onto the back of the human being to facilitate portability from one location to another. A portion of the strap assembly 98 is connected to the stub shaft 24 with a similar portion in the form of connecting strap 101 of strap assembly 98 being connected to the stub shaft 26.

With the chair 10 in the retracted/stowage position, the strap assemblies 98 and 100 can be utilized and the chair carried from one location to another. The utilizing of the strap assemblies 98 and 100 leaves the hands of the user free in order to carry other objects or to accomplish other functions since hand carrying of the chair 10 is not required.

Figures 6, 7:
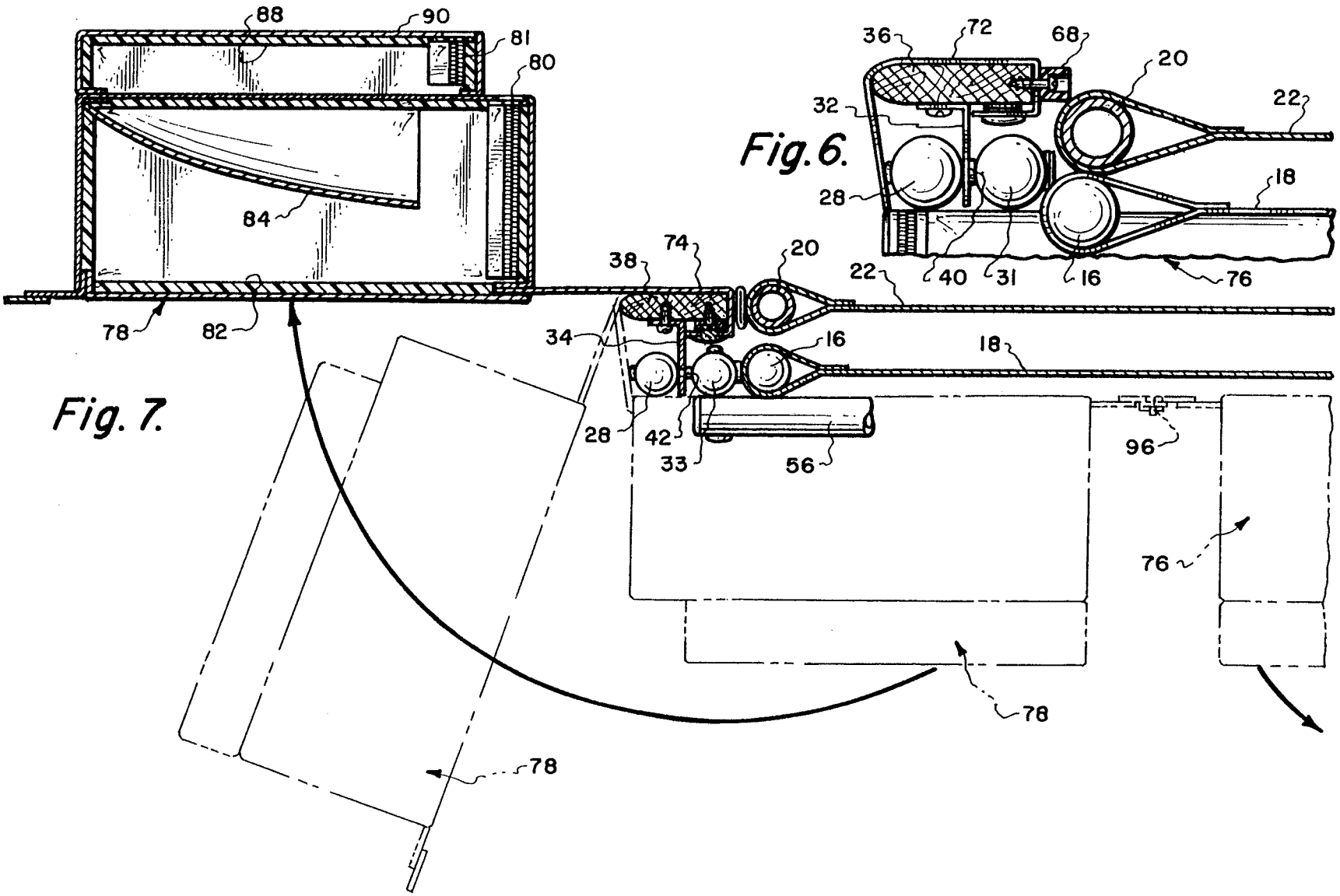
FIG. 6 is a cross-sectional view showing the Locking arrangement between the back section and the armrest when the chair is in the retracted/stowage position.
FIG. 7 is a cross-sectional view showing the securing arrangement between one of the ice chest pouches and an armrest and also clearly showing the movement of the ice chest pouch from when the chair is in the extended/usage position to when the chair is in the retracted/stowage position.

When the user gets to the desired location where the chair 10 is to be utilized, the user removes the chair 10 from the user's back and then first moves the protrusions 68 and 70 to the disengaging position which would be on the opposite side of the leg member 20 as is shown in FIG. 6 of the drawing. The user then disengages the umbrella strap 66 and removes the umbrella from hole 58 and connects the umbrella with the bracket 64. The user then unzips zipper 96. The chair 10 can then be moved to its extended/usable position as is shown in FIG. 8. When it is desired to no longer utilize the chair 10, the user is to merely reverse the procedure to again relocate the chair 10 in the retracted/stowage position.

What is claimed is:

1. A chair movable between an extended/usable position and a retracted/stowage position, said chair having a seat section, extending outward and beneath said seat section when said chair is in said extended/usable position is a leg assembly, said seat section having a back edge from which extends upwardly a back section, said seat section having opposing sides, a pair of armrests connected between said back section and said seat section with there being a said armrest located at and spaced upwardly from each said side when said chair is in said extended/usable position, the improvement comprising:

a first flexible walled pouch mounted on one said armrest, a second flexible walled pouch mounted on the remaining said armrest, each said flexible walled pouch adapted to function as an article carrier, said first flexible walled pouch having an attaching flap, said second flexible walled pouch having an attaching flap, each said attaching flap being secured to its respective said armrest, each said flexible walled pouch being pivotally movable relative to its respective said armrest with said flexible walled pouches being locatable in either an aligned position or a spaced apart position with this pivotal movement ocurring at each said attaching flap, when in said aligned position said first flexible walled pouch being aligned with said second flexible walled pouch and means for joining said pouches together when said chair is in said retracted/stowage position.

2. The chair as defined in claim 1 wherein:

said first flexible walled pouch being identical to said second flexible walled pouch with the exception of being a mirror image thereof.

3. The chair as defined in claim 1 wherein:

said joining means comprising a zipper.

4. The chair as defined in claim 1 wherein:

an umbrella mounting bracket being mounted on said back section, an umbrella to connect with said umbrella mounting bracket when said chair is in said extended/usable position, when said chair is in said retracted/stowage position said umbrella to be repositioned at a storage location in juxtaposition with said chair.

5. The chair as defined in claim 1 including:

back pack straps mounted on said back section, when said chair is in said retracted/stowage position said back pack straps being usable to facilitate carrying of said chair on the back of a human being.

6. The chair as defined in claim 1 including:

locking means mounted on said armrests, said locking means to lockingly connect with said back section when said chair is in said retracted/stowage position so as to maintain the position of said chair in said retracted/stowage position.

* * * * *